United States Patent [19]

Fenwick

[11] Patent Number: 4,884,804

[45] Date of Patent: Dec. 5, 1989

[54] EXERCISE APPARATUS

[76] Inventor: Chad Fenwick, 8954 Nestle Ave., Northridge, Calif. 91325

[21] Appl. No.: 144,633

[22] Filed: Jan. 11, 1988

Related U.S. Application Data

[63] Continuation of Ser. No. 881,644, Jul. 2, 1986, abandoned.

[51] Int. Cl.[4] ..... A63B 23/02

[52] U.S. Cl. ..... 272/145; 272/93; 272/144

[58] Field of Search ..... 272/144, 145, 93, DIG. 4; 128/68–75

[56] References Cited

U.S. PATENT DOCUMENTS

| | | | |
|---|---|---|---|
| 2,640,480 | 6/1953 | Hill | 128/75 |
| 3,339,544 | 9/1967 | Kravitz | 128/70 X |
| 3,342,485 | 9/1967 | Gaul | 272/145 |
| 3,598,405 | 8/1971 | Burns | 272/145 |
| 3,628,790 | 12/1971 | Gordon | 272/145 X |
| 3,658,327 | 4/1972 | Thiede | 272/DIG. 4 X |
| 3,682,475 | 8/1972 | Walker | 272/145 |
| 4,332,381 | 6/1982 | Lyons | 272/144 |
| 4,383,684 | 5/1983 | Schliep | 272/145 X |
| 4,398,713 | 8/1983 | Ellis | 272/145 |
| 4,470,408 | 9/1984 | Gordon | 272/145 X |
| 4,502,682 | 3/1985 | Miller | 272/144 |
| 4,565,370 | 1/1986 | Christianson | 272/145 |
| 4,629,180 | 12/1986 | Kaya | 272/145 X |

*Primary Examiner*—Richard J. Apley
*Assistant Examiner*—Robert W. Bahr
*Attorney, Agent, or Firm*—Blakely, Sokoloff, Taylor & Zafman

[57] ABSTRACT

A device for exercising producing limited strain on the back. The exerciser is supported on a base which also provides a mounting surface for an upright. The upright supports a leg rest where the exerciser's legs are placed during use. With legs elevated on the leg rest the exerciser does sit-ups. Attachment of the leg rest to the upright is done in such a way that it may be disposed at a plurality of heights for adjustment to the user's needs. To vary the exercise difficulty the angle of inclination of the platform may be adjusted either when used in conjunction with other exercise apparatus or when used along with use of the appropriate attachment.

12 Claims, 3 Drawing Sheets

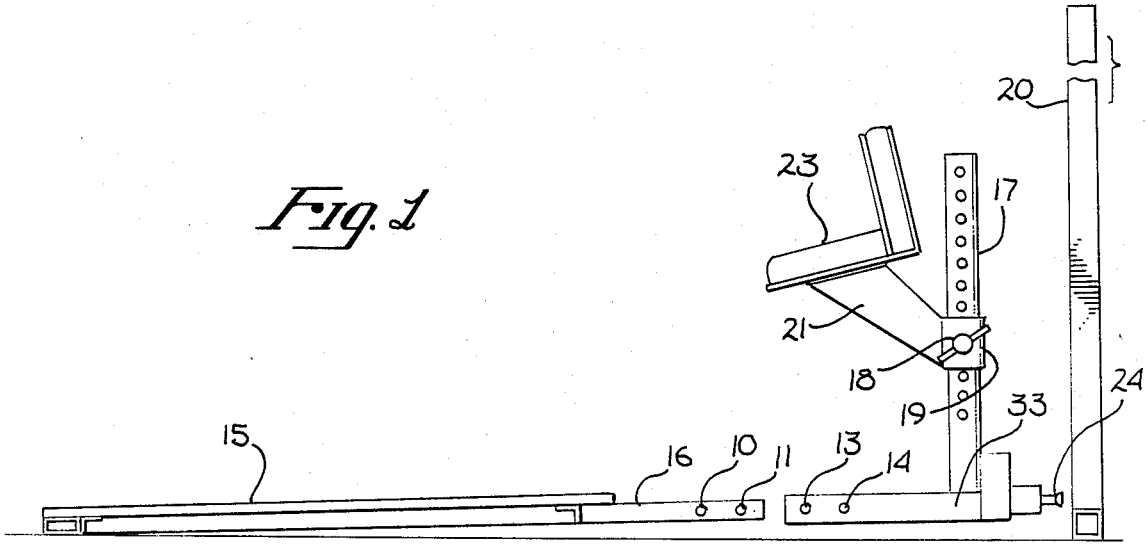
Fig. 1
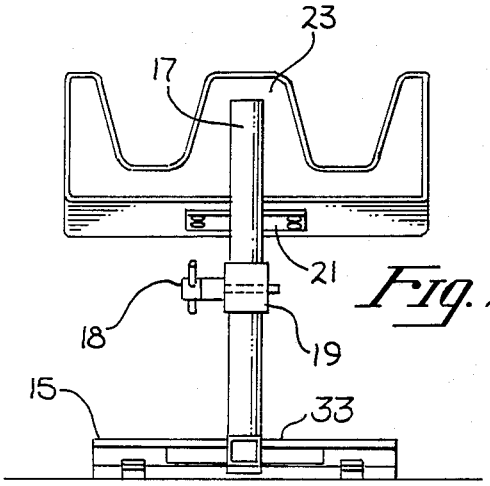
Fig. 2
Fig. 3a
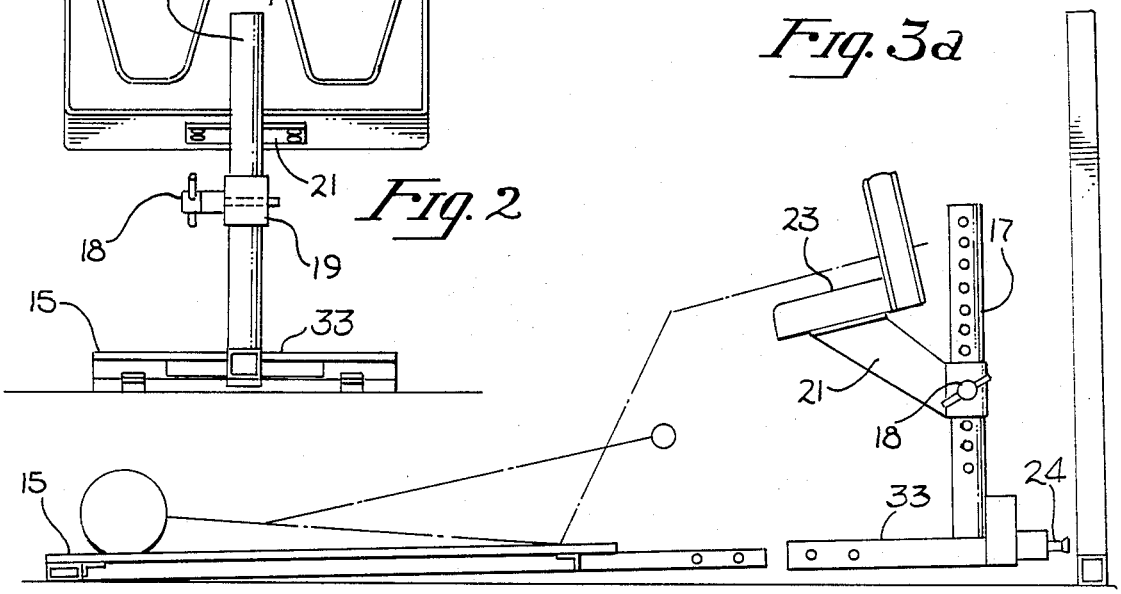
Fig. 3b
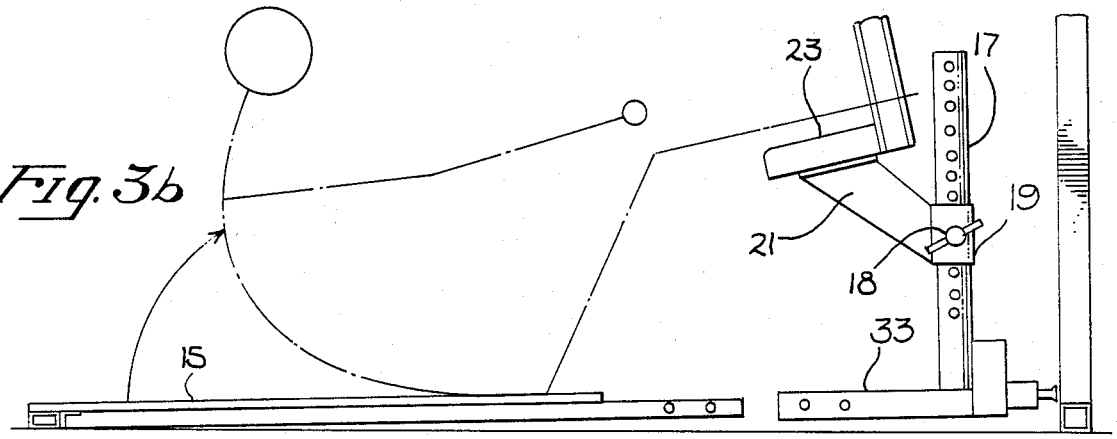

Fig. 4
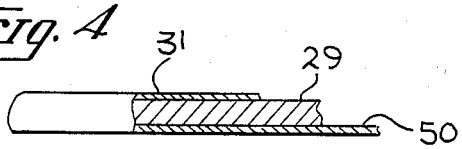
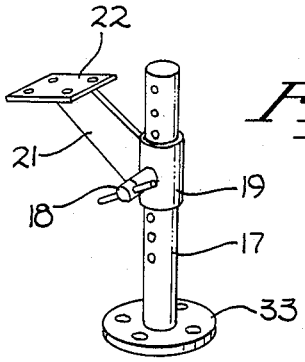
Fig. 5
Fig. 6a
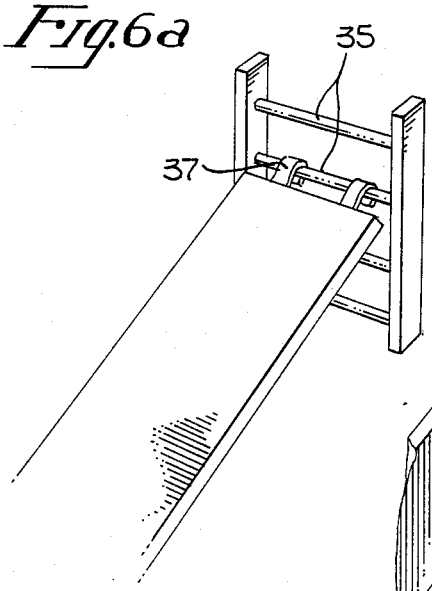
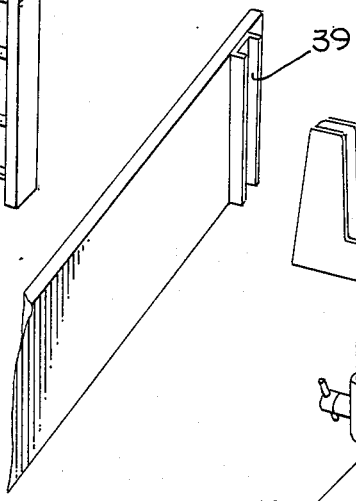
Fig. 6b
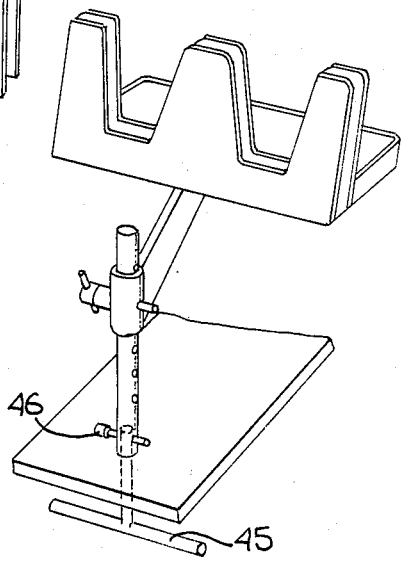
Fig. 7

EXERCISE APPARATUS

This is a continuation of application Ser. No. 881,644 filed July 2, 1986 now abandoned.

BACKGROUND OF THE INVENTION

1. Field of the Invention

This invention relates to the field of exercise devices.

2. Prior Art

When exercising it is often desired to isolate a particular region of the body in order to maximize the benefits of exercise to that area. For example, strengthening the stomach and abdomen region may be desired, so this area is isolated. One exercise used to work this region is the sit-up.

In the prior art, several devices are available to aid in performing sit-ups. Such devices are described in U.S. Pat. Nos. 2,895,736; 1,953,857; 695,538; and 4,188,029.

U.S. Pat. No. 4,188,029 provides, in part, a sit-up board. This invention aids the exerciser in performing sit-ups by using a padded roller under which the user can hook his legs to provide a leverage point for moving from the prone position to an upright position. U.S. Pat. No. 2,895,736 provides a similar means for securing the exerciser's legs to facilitate the exercise. U.S. Pat. No. 1,953,857 produces the same result as '029 and '736 listed above by providing two hooks under which the user's ankles can be held. For use in a similar manner, U.S. Pat. No. 695,538 provides a means for securing the user's feet. All of the above-listed inventions have the disadvantage of producing strain on the user's back caused by the muscle tension in the legs resulting from of the type of restraint used. This is due to the fact that during sit ups, the tendency of the legs is to rise. When the legs are restrained from rising strain is created on the back in excess of the force needed for sitting up.

Therefore, it is the object of the present invention to provide an exercise device which will reduce strain on the user's back during sit-ups.

SUMMARY OF THE INVENTION

It is a primary object of this invention to provide a means for limiting back stress when doing sit-ups. To accomplish this, the exerciser's lower legs are elevated. In this position, the user forces his upper body towards his elevated legs thus avoiding pull on the back from muscle tension in the legs. Additionally, the legs in this position tend to be forced down during a sit-up, which does not create unneeded force and stress on the user's back. The result is a lower risk of injury to the back than that associated with conventional sit-up boards. Additionally, by disposing the upper legs at an angle, the back straightens from its normally curve shape so that tension which does result in the back is less likely to cause injury. The invention also provides an adjustable means for supporting the user's legs so that the height may be easily varied to accommodate different users, or as comfort may require. Additionally, the invention can be disposed at different angles to vary the exercise difficulty, either when used by itself, or when combined with other exercise apparatus.

BRIEF DESCRIPTION OF THE DRAWINGS

FIG. 1 is a side-view of the preferred embodiment of the present invention.

FIG. 2 is an end view of the preferred embodiment of the present invention.

FIGS. 3(*a*) and 3(*b*) illustrate the invention of FIG. 1 in operation.

FIG. 4 is a cross-sectional view of the base of the present invention with a padded layer thereon.

FIG. 5 is a perspective view illustrating a mounting member of the present invention.

FIGS. 6(*a*) and 6(*b*) are perspective views illustrating means for elevating one end of the base.

FIG. 7 is a perspective view illustrating an alternate means for elevating one end of the base.

DETAILED DESCRIPTION

Figure 9:
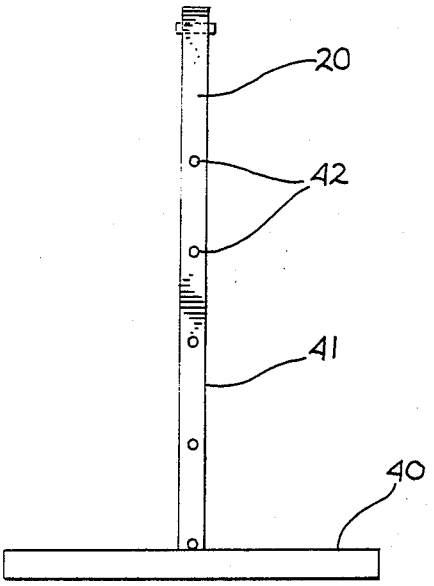
FIG. 9 is a front view of the T-Ladder of the present invention.

In the following description numerous specific details are set forth in order to provide a thorough understanding of the present invention. However, it will be obvious to one skilled in the art that the present invention may be constructed without these specific details. In other instances well-known technology has not been described in detail in order not to unnecessarily obscure the present invention.

The present invention as depicted in its preferred embodiment in FIG. 1 is intended to provide a means for elevating an exerciser's legs while performing sit-ups. Through the use of this invention the user is less prone to back injury since with legs in the elevated position the muscles used in performing sit-ups create less strain on the back. Additionally, by disposing the upper legs at an angle the naturally curved lower portion of the back straightens so that any stress which does result in the back is less likely to cause an injury.

The exercise appartus consists generally of a base comprising a padded member 15 and joist 16, and an upright member 17. A leg rest 23 is coupled to the upright 17 and is used to support the user's legs.

FIG. 1 illustrates the entire exercise apparatus. The base has two functions. The first function is to support the exerciser's body and provide a surface on which to perform the exercise, and the second is to provide a mounting surface for the upright member 17. As such, the base may be constructed of any material which will facilitate these two functions. In the preferred embodiment, the base is comprised of a rigid joist 16 on which is mounted a padded member 15.

The thickness of the padded member 15 will be greatly dependent on the material used for its substrate. Stronger materials will allow the base to be thinner. The thickness should take into account the exerciser's body weight and the manner in which the upright member 17 is to be attached. In determining the length and width, it should be considered that the base must be large enough to both mount the upright and support the exerciser's body. The base need only extend far enough away from where the upright is mounted, to support the exerciser's buttocks but in the preferred embodiment, the base is of sufficient length to provide back support for the user. The exerciser's weight on the base provides stability to the entire unit during use. By extending the base underneath the exerciser, lateral movement of the leg rest is also prevented. By extending the base to support the user's head, the comfort of the device will be increased since the upper torso will have an even surface to lie on during use. The base in the preferred embodiment is rectangular or square but may be shaped as other functions or appearance require.

The padded member 15 is shown in detail in FIG. 4. A sheet of vinyl, leather or other flexible cover material member 31 is stretched across a foam layer 29 and tacked down on the sides of a substrate 50. The substrate 50 is a rigid material such as wood or metal. An alternate embodiment utilizes foam having a smooth surface so that covering is not necessary.

Upright member 17 provides a mounting for the leg rest 23 and is attached to the joist 16. Upright member 17 includes elongated member 33 having an iside diameter greater than the outer diameter of joist 16. Member 33 includes openings 13 and 14 throughwhich bolts can be inserted. Joist 16 is inserted into member 33 so that openings 10 and 11 on joist 16 are coincident with openings 13 and 14 in member 33. Bolts may then be passed through the openings and tightened to provide a secure coupling of joist 16 and upright member 17.

Figure 8:
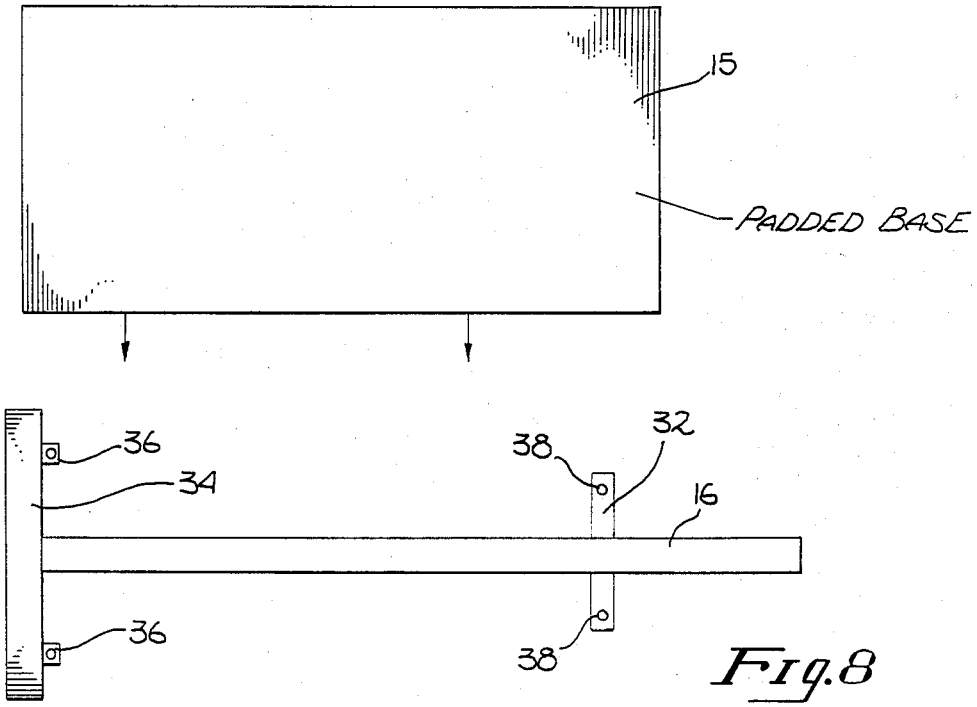
FIG. 8 is a top view of the base and joist of the present invention.

The base of the present invention is shown in greater detail in FIG. 8. As shown, the joist 16 is basically "T" shaped with a central elongated portion and cross members 34 and 32 mounted substantially perpendicular to the elongated member. Cross member 34 includes openings 36 so that the joist may be securely coupled to the padded base 15 through the use of screws of bolts. In addition, cross member 32 includes openings 38 so that cross member 32 may also be fastened to the underside of padded base 15.

In the preferred embodiment, the leg rest 23 is attached in a way by which the height can be altered to accommodate users of different sizes. One method for making the height of the leg rest mount adjustable is by attaching the leg rest to a sleeve 19 having a slightly larger inside diameter than the upright's outer diameter so that the sleeve can pass freely over the upright. The leg rest 23 is held coupled to the upright 17 with a pin 18 passing through the sleeve 19 into the upright 17. The pin 18 may be biased by a spring or moved by hand such that it protrudes towards the sleeve's center. When the sleeve is put over the upright and properly aligned, the pin will pass through the upright fixing the sleeve 19 and the attached leg rest 23 at a particular location. If openings are formed in the upright 17 in a number of locations along its length, then the leg rest can be fixed at any of these locations.

The leg rest may be fixed to the sleeve through the use of an angled member 21 mounted radially to the sleeve as shown in FIGS. 1 and 5. This member may be attached to a plate 22 which provides a surface on which to mount the leg rest 23. The leg rest itself may be constructed in any of the same ways as the base, however its construction need not be quite as strong since normal use will not require it to bear the same weight as the base. Abuse is likely though, and the rest should be designed so that it is capable of bearing the entire body weight. In the preferred embodiment, the leg rest 23 is at the same width as the base and is aligned with the base. To provide comfort, a layer of padding is provided on the leg rest 23.

In order to increase the difficulty of the exercise performed on the board, it is often desired to have one end of the board higher than the other. For example, it may be desired to elevate the end which supports the feet substantially over the end which supports the head area of a user. Referring to FIG. 1, the preferred embodiment of the present invention includes a spring loaded pin 24 which may be inserted into a "T Ladder" 20. The T Ladder, shown in front view in FIG. 9, includes a plurality of openings 42 for accepting the pin 24 and supporting the board at a plurality of different heights. The T Ladder consists of a cross member 40 and a perpendicularly mounted upright member 41.

As shown in FIG. 6(*a*), elevating the end of sit-up boards may also be done using bar members 35 mounted horizontally, spaced apart vertically, bearing resemblance to a ladder, so that a sit-up board with a means for engaging the bars may be hung on any of the rungs as shown in FIG. 6(*a*). In FIG. 6(*a*), hooks 37 are attached to the forward edge of the base. FIG. 6(*b*) illustrates a channel member 39 attached to the bottom of the base. Both the hooks and the channel when laid over the bar will restrain the apparatus in an elevated position while in use. In other instances, it may be useful to attach a peg member to the front edge of the base so that it can engage an upright with openings along its length.

Alternatively, if the sit-up board is to be used by itself, the front may be elevated by combining an elevating member 45 with upright member 17, as shown in FIG. 7. The elevating member 45 is inserted through the base into upright 17. The distance which the elevating member 45 extends out of the bottom of the base can be altered to dispose the board at different angles by passing a pin 46 through an opening formed in upright member 17, into any number of holes spaced along the elevating member 45. In the preferred embodiment, the elevating member 45 is comprised in tubing in the shape of an inverted "T".

An alternate embodiment of the present invention as depicted in FIG. 3 is to extend the base back front the upright 17 only far enough to support the exerciser's buttocks. Additionally, the base is elevated through the use of legs 27 attached to the base. By elevating the apparatus and limiting the extension of the base, the arc through which the exerciser can rotate his upper body is greatly increased. When in use the exerciser can arch his back below the plane of the base. By so doing, the difficulty and usefulness of the exercise may be increased.

Figure 10:
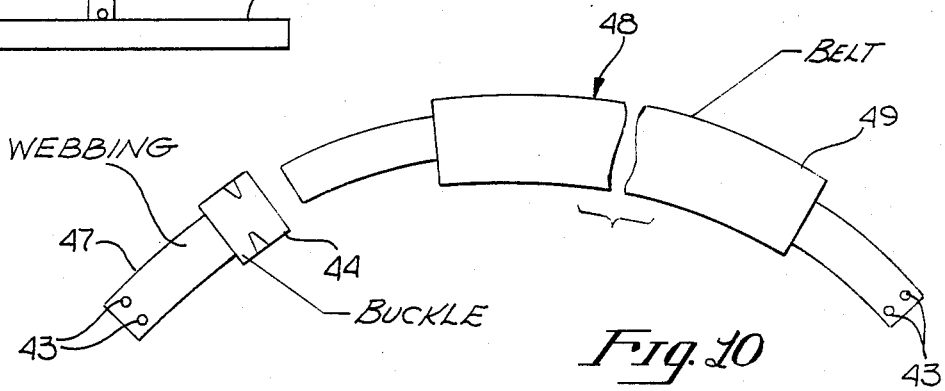
FIG. 10 illustrates a belt used with one embodiment of the present invention.

In order to prevent a user from arching his back incorrectly during performance of a sit-up exercise utilizing the present invention, a belt such as shown in FIG. 10 may be fastened to the board and used to secure a user to the board. The belt consists of webbing 47 and a padded area 49. The belt includes openings 43 for securely fastening the belt to the underside of the padded member 15. As shown in FIG. 10, the belt 48 includes a buckle 44 for adjustably securing the belt to a user. However, other types of fastening, such as VELCRO, may be utilized advantageously as well.

Construction of the base can be of any substrate material which will support the user's weight and allow mounting of the upright. In addition to plywood, other possibilities include, but are not limited to hard plastic, fiberglass, and metal such as aluminum or steel.

Use of the apparatus begins as shown in FIG. 2 (*a*) with the user laying at rest on the base member 15 and legs elevated on the leg rest member 23. From this position the exerciser bends forward as shown in FIG. 2 (*b*). This movement is accomplished by contraction of the abdominal muscles so that the upper body is forced towards the elevated legs. When the exercise is performed in this manner the legs are pushed down rather than tending to lift up as in the prior art. When restraint is used tension is created in the legs which extends to the back. The present invention is therefore improved over the prior art.

What is claimed is:

1. An exercise apparatus for performing a sit up exercise comprising:

a base having a stationary support for supporting the torso of a user during said exercise;

an elongated member coupled to said base and substantially perpendicular to said base; and a support member coupled to said elongated member independently of said base and disposed above the plane of said base for elevating a user's lower legs and feet relative to his torso and supporting the user's feet and legs during said exercise, said support member comprising at least one pocket for preventing downward and lateral movement of said feet and allowing upward movement, the user's lower back being forced to curve outwardly during said exercise as a result of the user's lower legs and feet being elevated relative to the torso, thus reducing stress and risk of injury, utilization of said support member with at least one pocket providing the sole restraint for the user's feet.

2. The apparatus of claim 1, further including elevating means for elevating said base at one end.

3. The apparatus of claim 2, wherein said elongated member includes a plurality of attaching points for selectively coupling said support member.

4. The apparatus of claim 2, wherein said elevating means includes an attaching means for engaging one of a plurality of vertically spaced horizontal bars.

5. The apparatus of claim 2, wherein said base includes at least one peg coupled to one end thereof, said peg for engaging one of a plurality of holes spaced vertically in a T ladder.

6. An exercise apparatus for performing a sit up exercise comprising:

a rigid base having a stationary support for supporting the torso of a user during said exercise, said stationary support including padding for providing resilient support;

an upright member coupled to said base;

a sleeve removably coupled to said upright member; and a support member coupled to said sleeve independently of said base and disposed above the plane of said base for elevating and supporting a user's lower legs and feet relative to his torso during said exercise, said support member comprising first and second pockets for preventing downward and later movement of said feet and allowing upward movement, the user's lower back being forced to curve outwardly during said exercise as a result of the user's lower legs and feet being elevated to the torso, thus reducing stress and risk of injury, utilization of said support member with at least one pocket providing the sole restraining for the user's feet.

7. The appartus of claim 6, wherein said upright member includes a plurality of holes formed along its length for receiving a pin extending through said sleeve.

8. The apparatus of claim 6, wherein said base comprises a rigid member with a layer of foam thereon and further includes elevating means for elevating said base at one end.

9. The apparatus of claim 8, wherein said elevating means comprises hooks for engaging one of a plurality of vertically spaced horizontal bars.

10. The apparatus of claim 8, wherein said elevating means comprises a channel for engaging one of a plurality of vertically spaced horizontal bars.

11. The apparatus of claim 8, wherein said elevating means comprises a peg coupled to one end of said base for engaging one of a plurality of holes spaced vertically in a T ladder.

12. The apparatus of claim 6 further includes a belt coupled to said base for securing a user to said base.

* * * * *

UNITED STATES PATENT AND TRADEMARK OFFICE

CERTIFICATE OF CORRECTION

PATENT NO. : 4,884,804

DATED : 12/5/89

INVENTOR(S) : Fenwick

It is certified that error in the above-identified patent and that said Letters Patent is hereby corrected as shown below:

| | | |
|---|---|---|
| col. 01, line 54 | delete "curve" | insert --curved-- |
| col. 02, line 37 | delete "appartus" | insert --apparatus-- |
| col. 03, line 26 | delete "of" | insert --or-- |
| col. 04, line 32 | delete "front" | insert --from-- |
| col. 06, line 11 | delete "later" | insert --lateral-- |
| col. 06, line 18 | delete "restraining" | insert --restraint-- |
| col. 06, line 20 | delete "appartus" | insert --apparatus-- |

Signed and Sealed this

Twenty-first Day of May, 1991

*Attest:*

*Attesting Officer*

HARRY F. MANBECK, JR.

*Commissioner of Patents and Trademarks*